US005355686A

United States Patent [19]

Weiss

[11] Patent Number: 5,355,686

[45] Date of Patent: Oct. 18, 1994

[54] DUAL TEMPERATURE CONTROL OF REFRIGERATOR-FREEZER

[75] Inventor: John Weiss, Amityville, N.Y.

[73] Assignee: Micro Weiss Electronics, Inc., West Babylon, N.Y.

[21] Appl. No.: 105,493

[22] Filed: Aug. 11, 1993

[51] Int. Cl.[5] ..... F25D 17/06

[52] U.S. Cl. ..... 62/89; 62/158; 62/180; 62/186; 62/229

[58] Field of Search ..... 62/89, 155, 180, 186, 62/187, 182, 229, 228.1, 158, 157, 231, 203, 208

[56] References Cited

U.S. PATENT DOCUMENTS

| | | | |
|---|---|---|---|
| 3,107,502 | 10/1963 | Herndon, Jr. et al. | 62/180 |
| 3,117,429 | 1/1964 | Harley, Jr. et al. | 62/180 |
| 3,119,240 | 1/1964 | Devery | 62/180 X |
| 3,918,269 | 11/1975 | Summers et al. | 62/186 X |
| 4,439,998 | 4/1984 | Horvay et al. | 62/231 X |
| 4,481,787 | 11/1984 | Lynch | 62/229 X |
| 4,821,528 | 4/1989 | Tershak | 62/187 X |
| 4,834,169 | 5/1989 | Tershak et al. | 62/187 X |
| 4,966,010 | 10/1990 | Jaster et al. | 62/229 X |

*Primary Examiner*—Harry B. Tanner

*Attorney, Agent, or Firm*—Frishauf, Holtz, Goodman & Woodward

[57] ABSTRACT

A dual compartment single evaporator refrigerator and temperature control apparatus that effectively controls two compartment temperatures by making the evaporator fan control independent of the compressor cycle. The compressor cycle is initiated by the fresh food compartment temperature, runs for a predetermined minimum time, and is terminated by the freezer temperature. The evaporator fan runs with the compressor and is terminated by the freezer control temperature. A small portion of the evaporator air circulation flows through the fresh food compartment and compartment temperatures are balanced according to the freezer temperature settings during the post-compressor cycle fan control. The temperature control set points to operate the compressor and fan are based on algorithms that compensate the control for the combination of freezer and fresh food temperature settings.

26 Claims, 11 Drawing Sheets

25
20
15
10
5
0
-5
540
570
600
FRZ TEMP/MIN.
41
50
48
46
44
42
40
38
36
34
32
30
FF TEMP/MIN.
42
60
50
40
30
20
10
0
-10
-20
CONTROL TEMP/MIN.
40

DUAL TEMPERATURE CONTROL OF REFRIGERATOR-FREEZER

BACKGROUND OF INVENTION

This invention relates to the dual temperature control of a refrigerator having a fresh food compartment and freezer compartment utilizing a single compressor, evaporator, and evaporator fan.

Present refrigerators using vapor compression refrigeration cycles attempt to control the freezer temperature relative to the fresh food temperature by controlling the air flow between compartments using adjustable dampers. The thermostat, generally a vapor expansion type, is located in the top of the fresh food compartment near the air stream flowing to the fresh food compartment from the freezer. The compressor is controlled by the thermostat and the freezer is regulated by adjusting the damper. Reducing the air flow to the fresh food compartment causes the compressor to run for a longer period of time before the thermostat cools to the temperature required to turn off the compressor and evaporator fan. With reduced air to the fresh food compartment and with longer compressor cycles the freezer temperature will be relatively colder. Generally the dampers are manually controlled with a lever or knob on a graduated panel within the fresh food compartment to indicate the degree of coldness of the freezer. Other systems employ motorized or solenoid actuated dampers that are controlled by a separate thermostat within the freezer. Besides being subjected to freezing, the automatic damper devices provide only a relative temperature setting, since the compressor cycle is entirely controlled by the fresh food temperature. When attempting to control the compressor start by either the freezer temperature or the fresh food temperature the compressor cycles become more frequent and shorter duration resulting in a very inefficient operation. Neil Lynch, U.S. Pat. No. 4,481,787 and Heinz Jastor, U.S. Pat. No. 4,966,010 include with their inventions two evaporator fans to transfer air to the fresh food compartment from the freezer when the fresh food calls for cooling and the freezer does not. In the Lynch patent the extra fan serves an additional purpose of defrosting the evaporator coil with the fresh food air.

Both the Jastor patent and U.S. Pat. No. 4,439,998 by Julius Horvay attempt to independently control the freezer temperature by using two evaporators, two fans and control valve systems to selectively chill the evaporators. Lynch also includes valve-modulating the coolant to operate the evaporator in different modes depending on the need for cooling the fresh food or the need to cool the freezer compartments. In all of these referenced cases the inventors suggest the use of electronic or microprocessor based controls to overcome the complexity of the system, sequence the control and operate additional devices all in concert.

SUMMARY OF THE INVENTION

The control apparatus and method of control of the invention for a refrigerator that has two compartments, one for frozen goods and one for fresh food, uses a single compressor, evaporator and evaporator fan. Independent temperature control is achieved by initiating a compressor and fan cycle at a control temperature related to at least a fresh food temperature setting, operating the compressor for at least a minimum run time and terminating the compressor run at a control temperature related to at least a freezer temperature setting. When the compressor runs for only the minimum run time the evaporator fan cycle is extended beyond the compressor run until the freezer temperature rises to a freezer control point. A fixed portion of the air circulated by the evaporator fan is diverted through the fresh food compartment.

Control temperature algorithms based on the fresh food and freezer temperature settings are used to compensate the cycle for the combination of fresh food/-freezer temperature settings and for the nonlinear response with time. The refrigerator efficiency is improved by providing a minimum compressor running time to minimize the end losses due to the refrigerant pressure equalizations that occurs between compressor run cycles, by equalizing the temperatures of the freezer air and the evaporator coil after the compressor cycle terminates, and by preventing overcooling of the fresh food and of the freezer. Each cycle is automatically compensated for both compartment temperatures by the post compressor cycle fan control and the control temperature algorithms based on the combination of fresh food and freezer temperature settings. Control sequence reaction to transitory events (such as door openings and defrost cycles) prevents undershooting the control temperatures, thus saving energy and achieving closer temperature control. Cold air losses due to door openings are minimized by interrupting the fan operation at least when the freezer door is opened.

In the preferred embodiment, an electronic control uses two variable resistance devices, one for setting a fresh food temperature and one for setting a freezer temperature, and the setting temperatures are compared to the respective air temperature sensors for determining the activation of switches to control the compressor and/or the evaporator fan. Temperature scales are indicated on setting knobs of the variable resistance devices and, if implemented with use of a microprocessor, the settings can be displayed in digital or analog form on an LCD display, as further described below with reference to FIG. 4. The settings are not affected by loss of power and require no programming. When used with a microprocessor, other sensors can be employed to measure room humidity and door openings, thus providing energy-efficient control of the mullion heaters and the defrost cycle.

The refrigeration system comprising the compressor, condenser and (warm air) exhaust fan, the evaporator and (cold air) evaporator fan, nonadjustable expansion valve between compressor/condenser and evaporator, and associated tubing and hardware can be designed to optimize the efficiency with a chosen refrigerant, by operating the evaporator coil within a narrow temperature and vapor pressure range. This design optimization is even more important when considering the use of non CFC refrigerants whose efficiencies are more sensitive to the fill and operating conditions.

BRIEF DESCRIPTION OF DRAWINGS

The invention is further described by way of illustrative example with reference to the annexed drawings in which.

DETAILED DESCRIPTION OF EMBODIMENTS OF THE INVENTION

Figure 1:
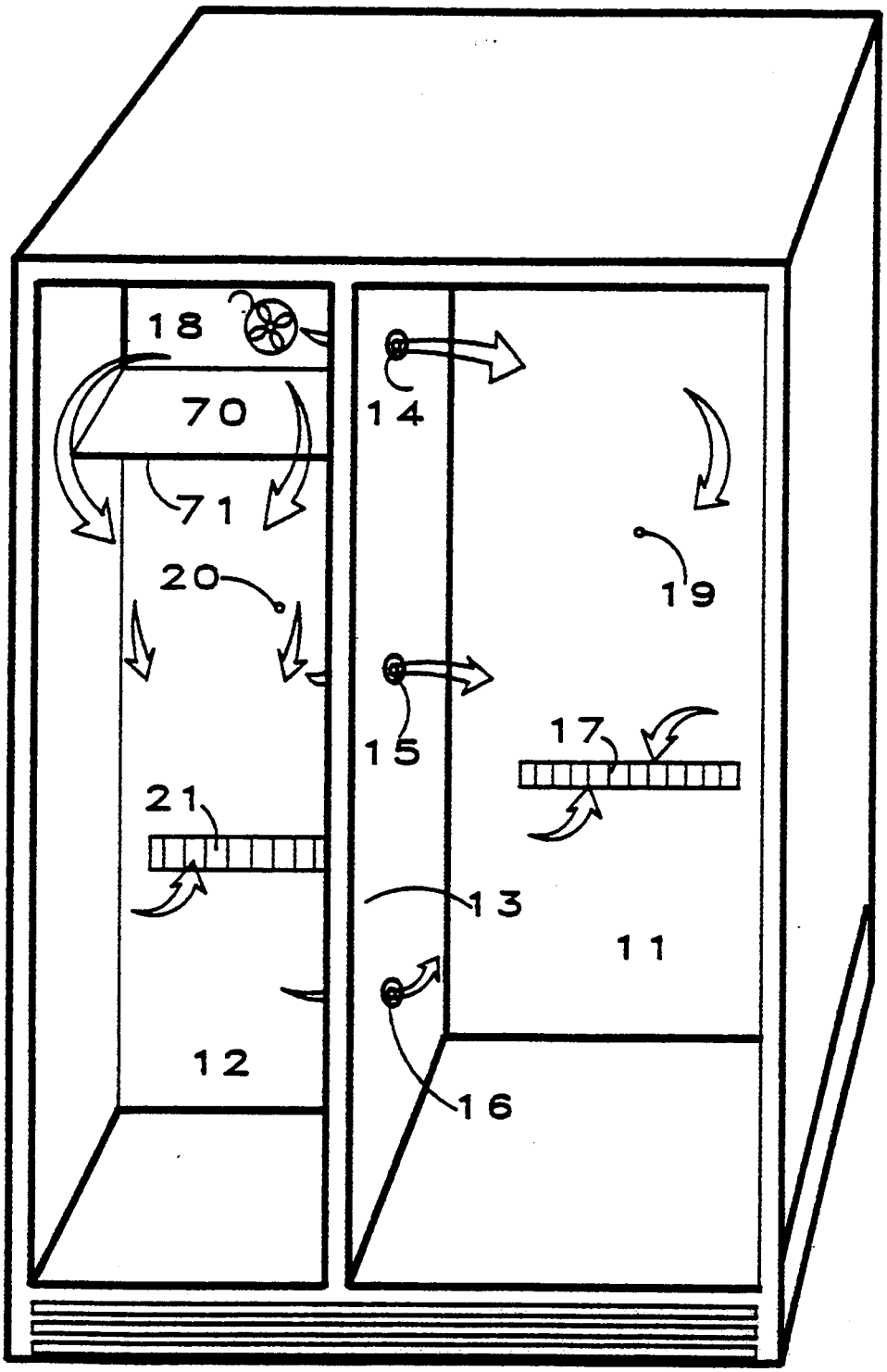
FIG. 1 is a front perspective view of the inside of a refrigerator/freezer of the invention showing the air flow.
Figure 2:
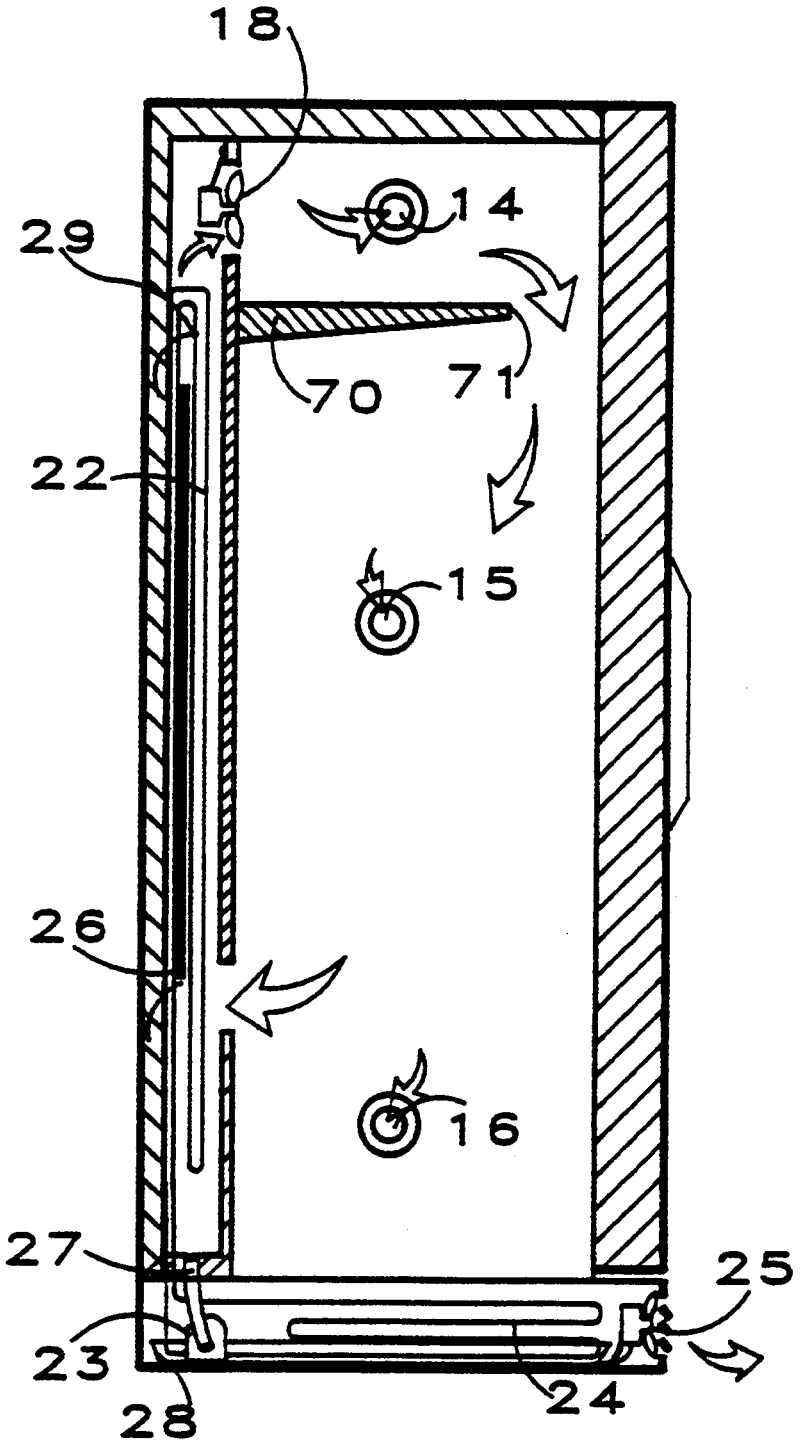
FIG. 2 is a cut-away side view of the evaporator and freezer section of the refrigerator/freezer of FIG. 1 showing the direction of air flow.

A combination refrigerator/freezer is shown in FIG. 1 having a fresh food compartment 11 and a freezer compartment 12 in side by side relation. A partition 13 separates the compartments and has an insulating construction. Air ports 14, 15, and 16 provide an air exchange between the compartments with the return ventilator 17 used to exchange air back to the evaporator. An evaporator fan 18 is used to draw air over the evaporator coils located in a chamber behind the freezer compartment and to supply cold air to both the freezer and the refrigerator compartment (arrows illustrate the air flow within and between the compartments). Immediately downstream of the evaporator fan, a port 14 in the partition 13 is located in a high air flow portion of the freezer compartment. This port is sized to divert a constant small portion of the chilled air to the fresh food compartment when the evaporator fan is on (running). The baffle 70 extends to its free edge 71 over a length designed to participate in determining what proportion of the chilled air goes through the port 14. A temperature sensor 19 is strategically located in the fresh food compartment to measure the air temperature. A temperature sensor 20 is located within the freezer compartment to measure the air temperature of the freezer. A ventilator 21 gathers the return air from the fresh food compartment to pass it again over the evaporator coil for cooling. The evaporator coil 22, FIG. 2, is cooled by liquid refrigerant ejected from the high pressure side of the compressor into the low pressure evaporator coil. The compressor liquifies the refrigerant in its condenser 24 and the heat of vaporization is absorbed by the condenser 24 as the liquid is expanded into vapor at the expansion valve 23. The condenser 24 and condenser fan 25 are located under the compartments for removal of the transferred heat by the exhaust fan 25.

The evaporator is equipped with a heater 26 to melt the frost during a defrost cycle. A drain tube 27 is used to transfer the runoff of water during the defrosting from the evaporator to the condenser pan 28. The runoff water evaporates in the condenser pan and provides some cooling to improve the condenser efficiency. A temperature sensor 29 is attached to the evaporator 22 for measuring the coil temperature to control the coil heating temperature and terminate the defrost cycle. To prevent overshooting the coil temperature, the power to the defrost heater is time proportioned.

Referring to the data plots of FIGS. 3*a*–3*g*, the left window is a time temperature plot of three standard (typical comestible) products respectively on the upper, middle and lower shelves of the freezer; the middle window contains time temperature data for three standard product loads in the fresh food compartment and the right data plot window contains the time temperature curves of the fresh food air temp, the freezer air temperature and the evaporator coil temperature. The temperature scale is in ° F. and the time scale is in minutes.

Figure 3A:
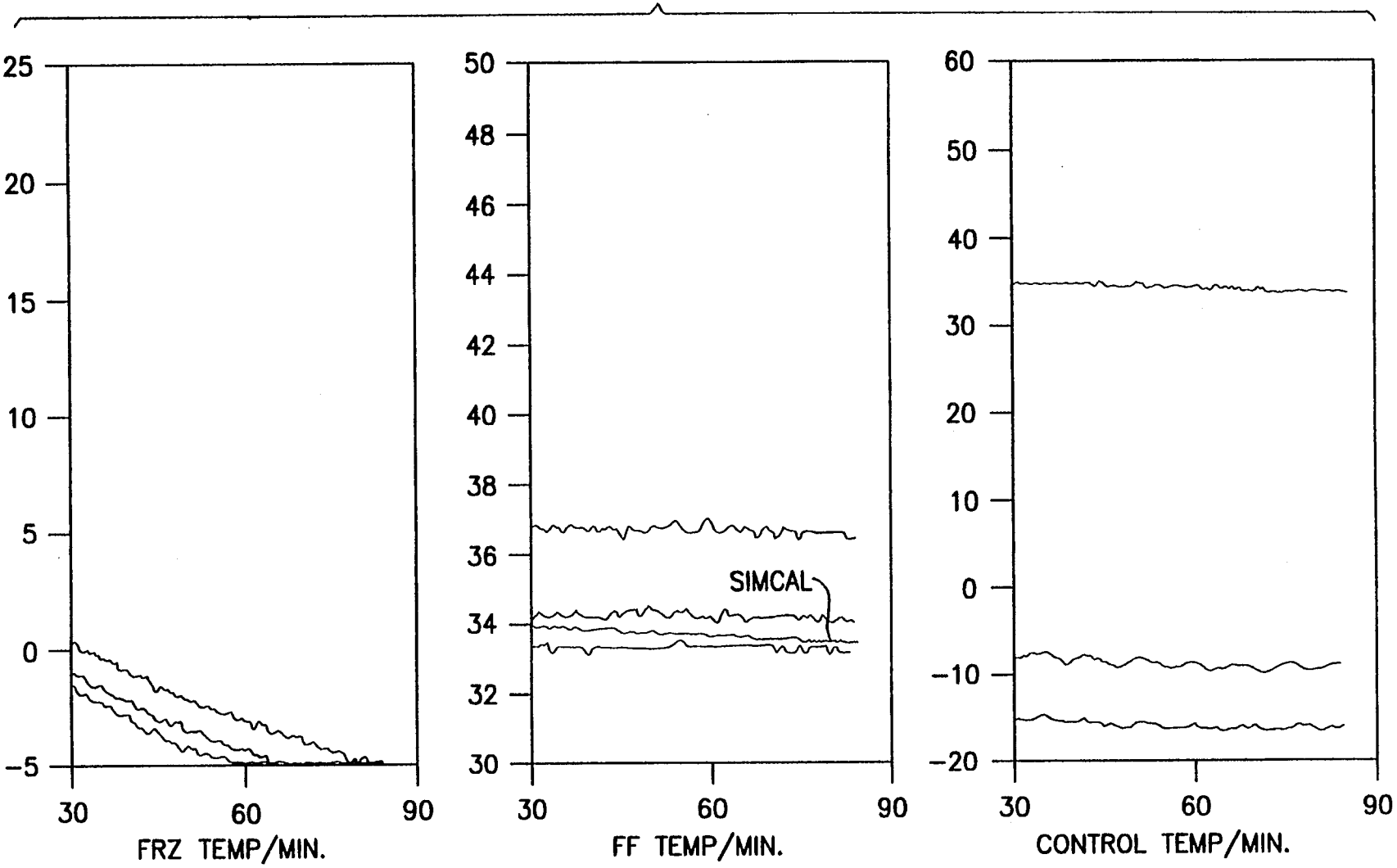
FIGS. 3*a*, 3*b* and 3*c* each show a set of 3 data plots relating to the prior art, each set plotting, separately, freezer food temperature, fresh food temperature and control temperature for 2 or more food items and FIGS. 3*d*–3*g* each show a set of 3 data plots relating to the practice of the invention, each set plotting, separately, freezer food temperature, fresh food temperature and control temperature for 2 or more food items.
Figure 3B:
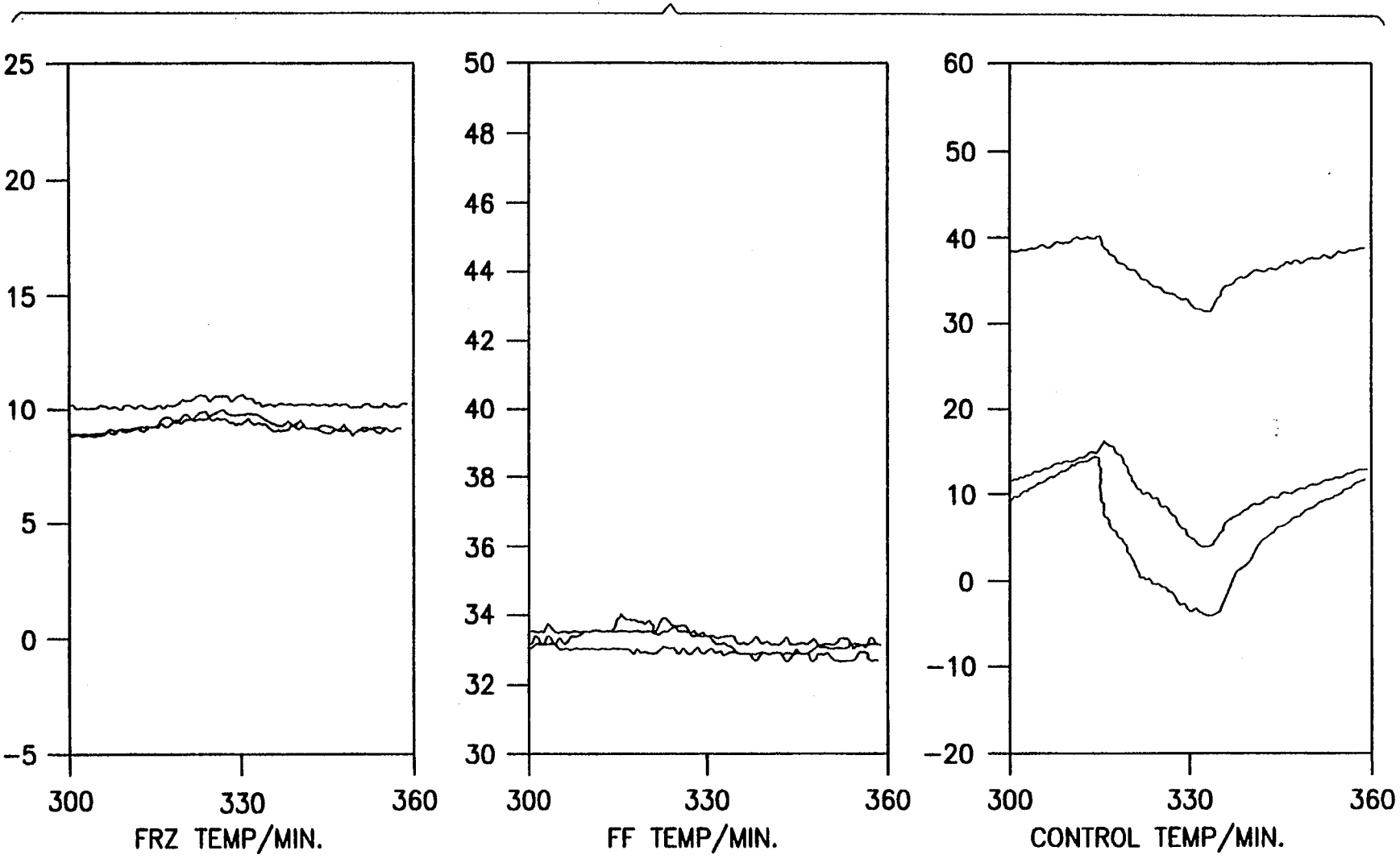

FIG. 3*a*shows the reaction to controlling the temperature of both fresh food and freezer compartments by conventional means using a control within the fresh food compartment with a fixed differential to establish the compressor start and stop. The result is that the freezer undercools. Controlling the freezer temperature by only adjusting an air damper between the compartments will allow more air to enter into the fresh food compartment, the fresh food temperature falls more rapidly and results in short compressor cycles, as shown in FIG. 3*b*.

Using the independent evaporator fan cycle of the invention after the compressor cycle in conjunction with a minimum compressor run time reduces both (1) the risk of overcooling the freezer and (2) the occurrence of inefficient short compressor cycles and results in closer temperature control with more efficient operation, as shown in FIGS. 3*d*–3*g*. Before those figures are described, however, the prior art problems under high ambient (room) temperature need consideration.

Figure 3C:
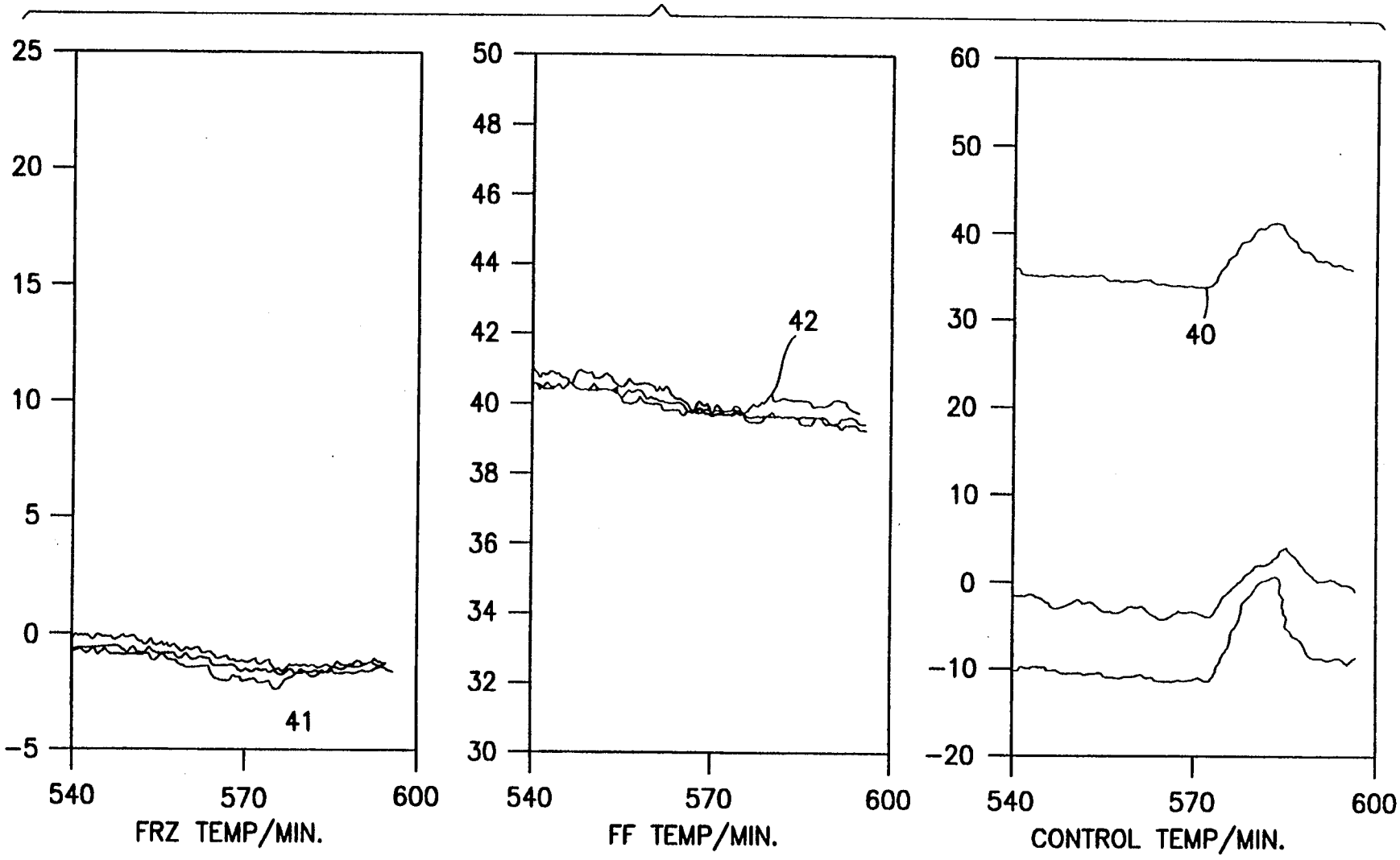

It is well understood that the control efficiencies are affected by the ambient temperature. As expected it requires more energy and closer control to maintain accurate low temperatures in condition of high ambient temperature conditions. In the summer, room temperatures of 90° F. or higher are not uncommon, energy ratings must take these conditions into account. Under shared air conditions, the fresh food compartment, having the largest volume and surface area, will take on heat to a greater proportion than the freezer compartment. High ambient temperatures result in longer compressor runs to achieve the cooling required to hold the set temperatures. The long compressor runs may result in colder relative freezer temperatures because the majority of the air circulation during the cooling cycle is in the freezer compartment and the air is at some temperature below the set point for the greater portion of the cycle. FIG. 3*c* is a data plot of an operating a conventional freezer/refrigerator at a high ambient condition. At the end of the compressor cycle shown at 40 the freezer product temperature 41 is below the freezer temperature setting 0° F. and the fresh food product temperature 42 is still dropping, however still above the fresh food temperature setting of 38° F.

OPERATION ACCORDING TO THE INVENTION (FIGS. 3*d*–3*g*)

Figure 3D:
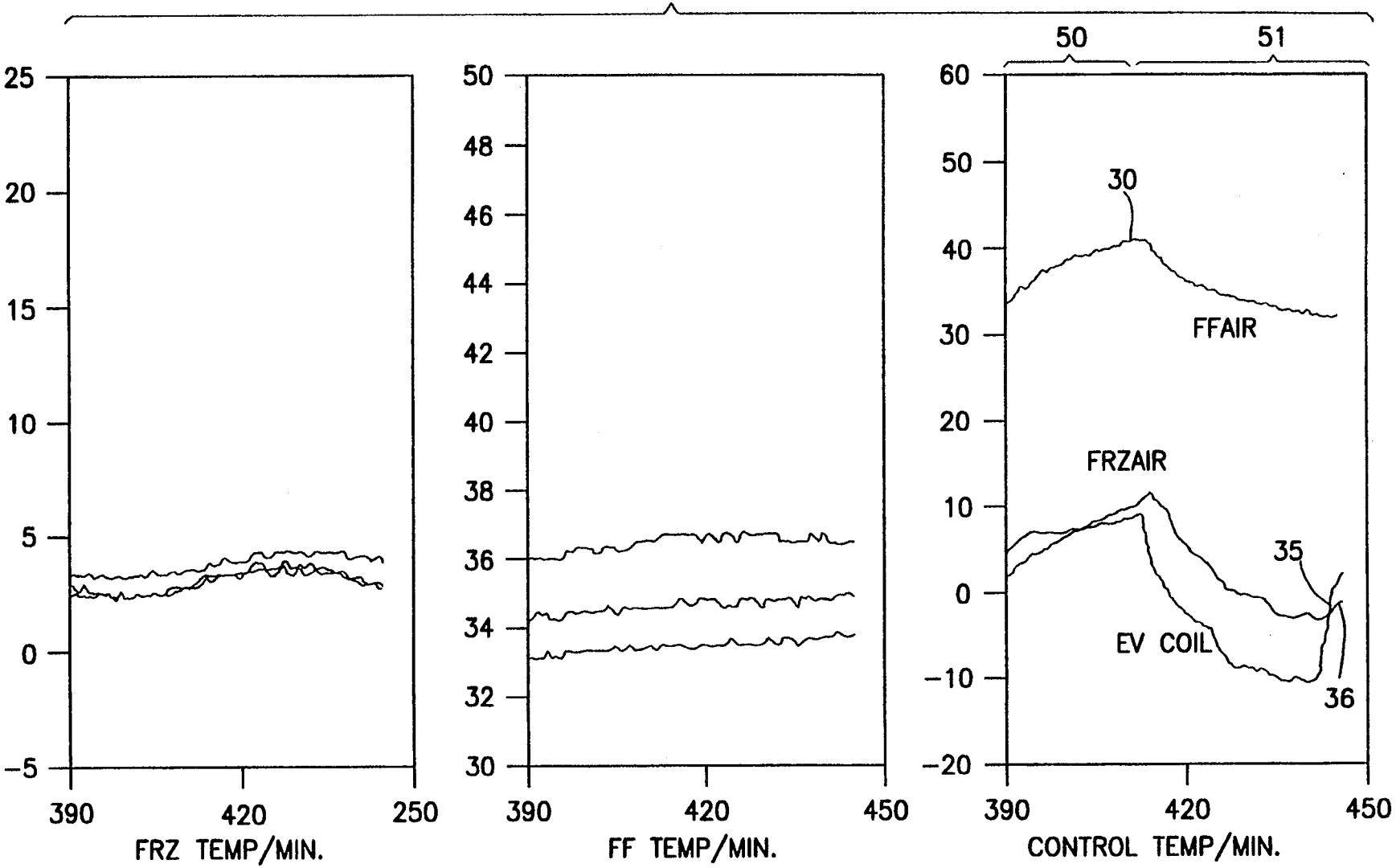

A normal compressor cycle according to the invention begins at 30, FIG. 3*d*, when the air temperature measured by sensor 19 (FIG. 1) in the fresh food compartment rises to a predetermined temperature, hereinafter referred to as the Fresh Food Control Point, FFCTL, which is above the fresh food setting.

Figure 3E:
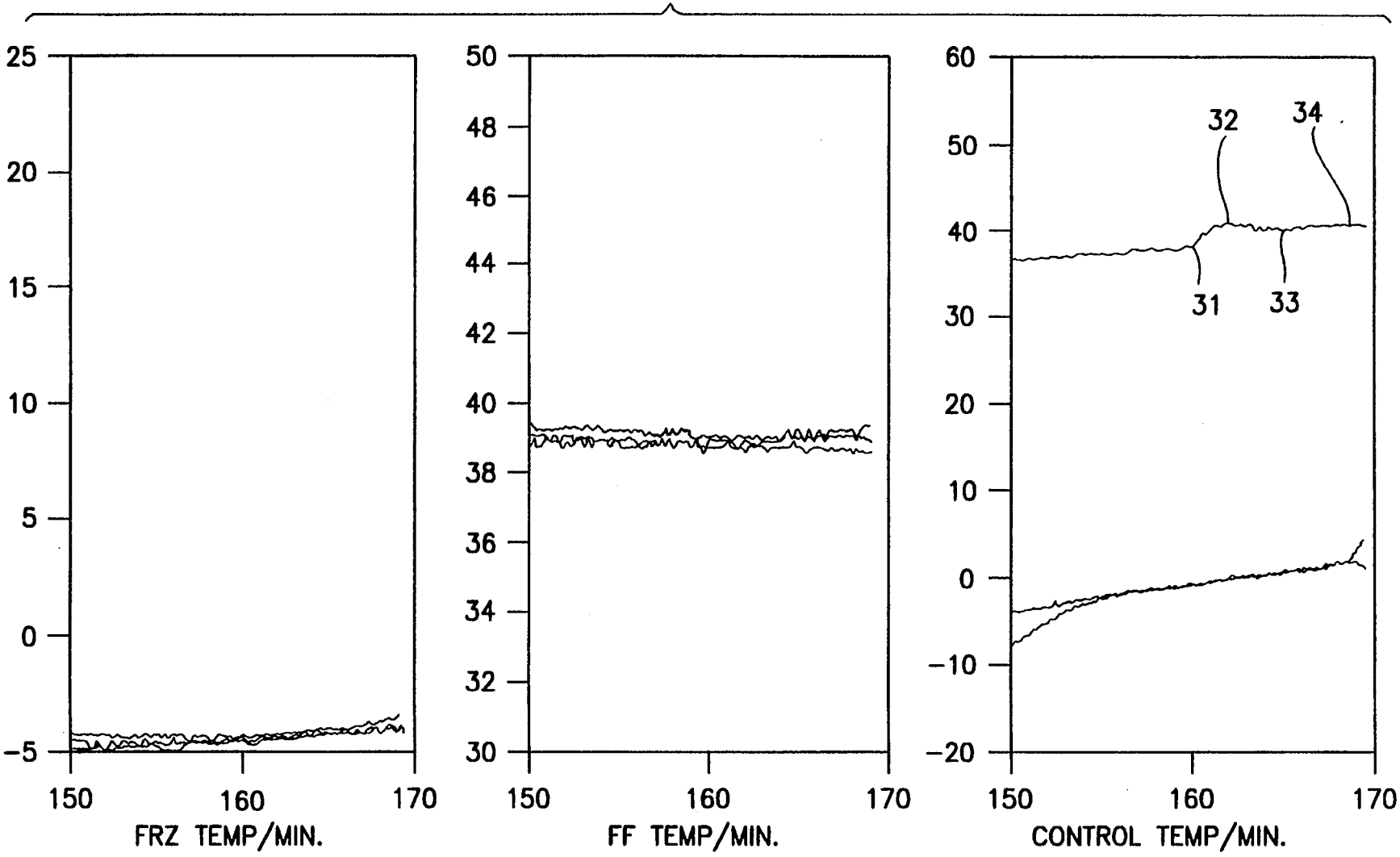

To prevent door openings from initiating the compressor run due to a temporary rise in the air temperature, a routine is used for detecting door openings by the change in the fresh food air temperature. FIG. 3*e* is a temperature data plot of a door opening event that allows infiltration of air from the room temporarily, thereby increasing the fresh food air temperature. Referring to the FF air temperature plot, the door opens at 31, giving rapid rise to the air temperature, closes at 32 and the fresh food air temperature declines, at 33 the fresh food air continues on the warming trend until the routine is satisfied at 34 and the compressor turns on. To minimize the end losses associated with the pressure equalizations between cycles, the compressor preferably runs for a minimum of 30 minutes. In general the minimum may be set at some value between 20 and 40 minutes.

Referring again to FIG. 3*d*, after the 30 minutes minimum compressor run cycle the control looks for the freezer air temperature to arrive at a temperature below the freezer temperature setting in order to terminate the compressor. That temperature is referred to herein as the Freezer Control Point, FRZCTL and, like the Fresh Food Control Point, FFCTL, is determined by a control temperature algorithm further described below.

In the event the freezer temperature is below the predetermined freezer control point at the end of the 30 minutes minimum compressor run cycle, the compressor is terminated at 35 (FIG. 3*d*) and the evaporator fan 18 continues to run until the freezer air temperature rises to the freezer control point. During this period, as shown on FIG. 3*d*, the fan operates independently from the compressor, with a portion of the air transferred to the fresh food compartment, the freezer air temperature increases, the fresh food air temperature continues to fall or levels off, the coil temperature continue to rise until the freezer control point is met and the fan operation is terminated at 36. This condition is expected with low fresh food settings and high freezer settings when strict compressor termination by the freezer air temperature setting would result in compressor cycles shorter than 30 minutes. Since the compressor start is based on the fresh food temperature the elongated fan cycle has the effect of delaying the next compressor start and prevents overcooling of the freezer compartment. The conditions continued heat exchange between the compartments is desirable to cool the fresh food and this can be done by providing a fan-only mode of control. According to the invention, this mode of control can best be operated with knowing the elapsed time of the long compressor runs, by measuring the ambient temperature and door openings that tend to warm the fresh food compartment, and by knowing a product simulated temperature.

Figure 3F:
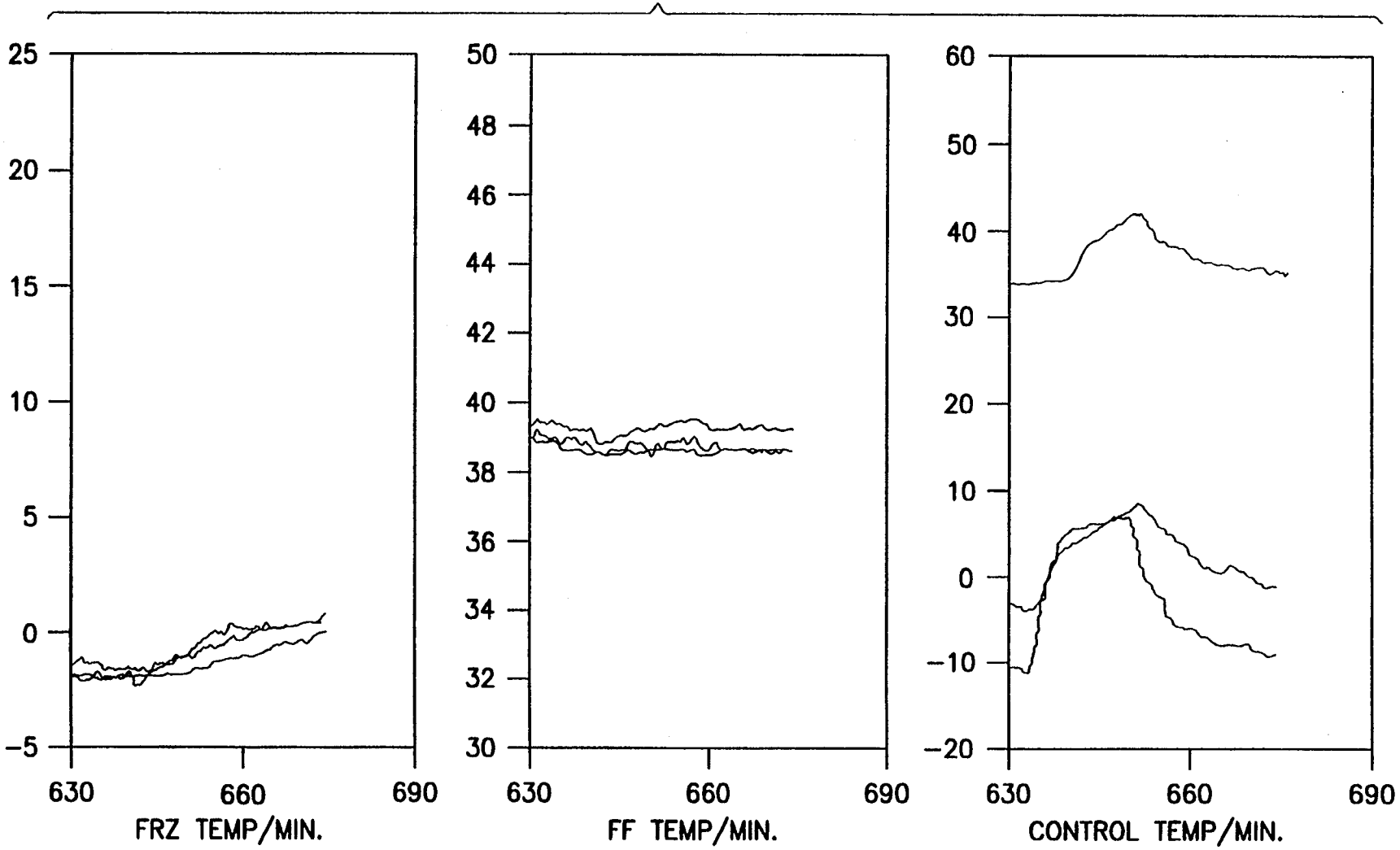
Figure 3G:
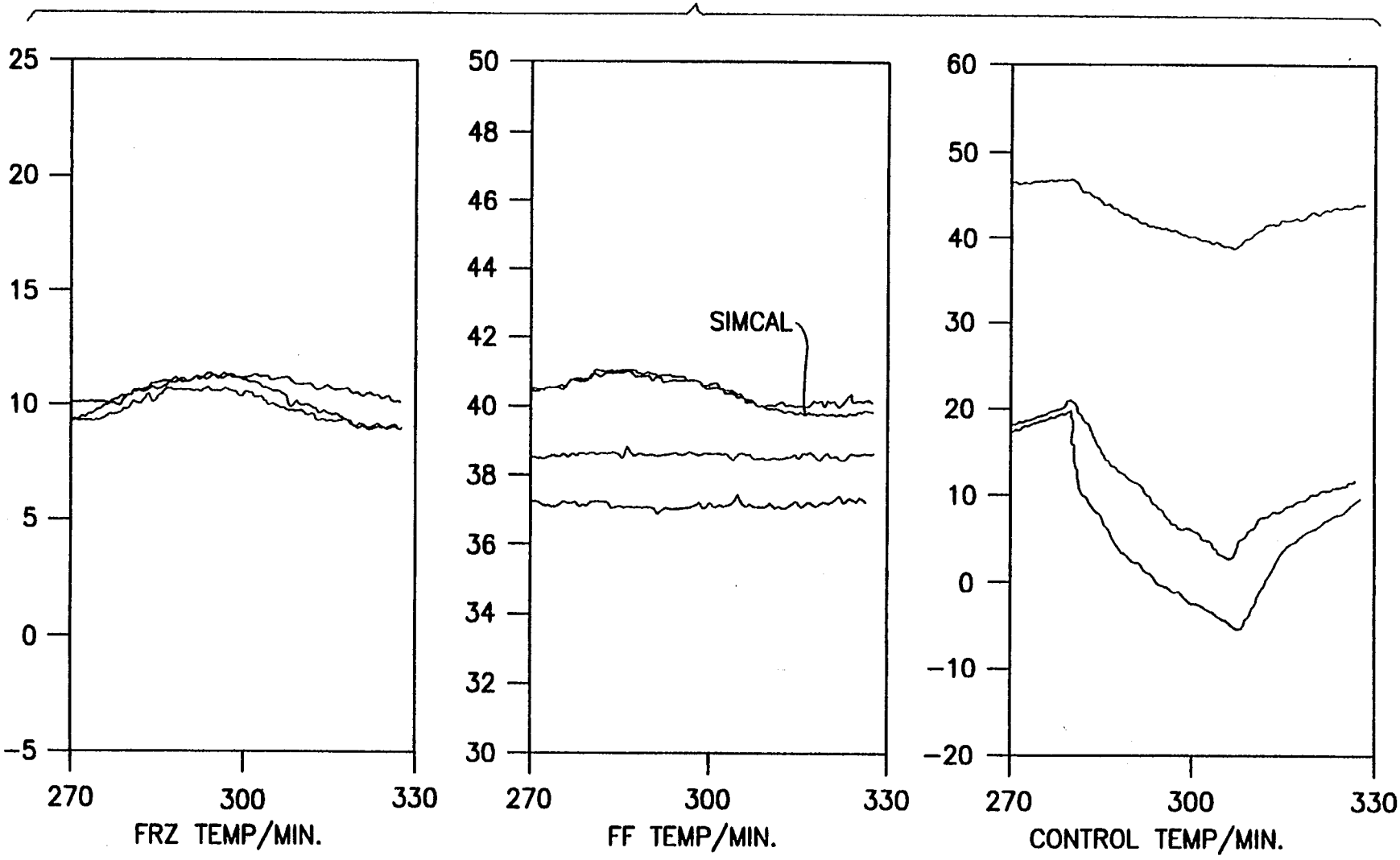

By using the post-compressor-cycle fan control of FIG. 3*f* with a routine based on the product simulated temperature, cold air is transferred to the fresh food section bringing both the freezer product and the fresh food product temperatures close to the settings, which for example may be 0° and 38° respectively. A weighted sensor having a mass that surrounds the sensor and is insulated to slow down the response to the fresh food air can be used to simulate the fresh food product, or else the product simulated temperature can be calculated by accumulating degree-minutes sensed by the fresh food air sensor 19 above and below the setting temperature. Actual products (comestibles) in the fresh food and in the freezer compartments will react to the changing air temperatures at various rates. Product response to air temperature changes are determined by the mass and heat capacity, the shape and surface area, the thermal conductivity of the product and the location within the air flow. Convection heat transfer between the moving air and solids is improved with increased velocity and also increased humidity. The heat transfer rate is greater when the evaporator fan is on.

When calculating degree minutes a constant greater than 0.1, for example 0.3, the difference between the air temperature and the setting temperature, for each minute of time the fan is on. The degree-minute accumulation (addition of values for each minute) is a measure of the heat transferred to and extracted from a simulated (food) product, and can be expressed by the formula:

TABLE 1

$$L = \frac{\sum_{0}^{X} \cdot 3 * (FF - FFSET)}{X} \quad \text{FAN ON}$$

$$L = \frac{\sum_{0}^{Y} \cdot 1 * (FF - FFSET)}{Y} \quad \text{FAN OFF}$$

where L is the degree-minute accumulation from 0 to x minutes measured from the fan start and 0 to y minutes measured from the fan switch-off time. They are added together for use of the sum method for simulating product temperature, but a cycle reset is needed to zero-adjust at some point in the cycle to prevent the tolerance build up from cycle to cycle.

The conditions for long compressor runs that overcool the freezer and undercool the fresh food product can result from high ambient temperatures sensitized by the combination of low freezer settings and high fresh food settings. The data plots of Figs. 3*a*–3*f* all show that the product temperature lags the air temperatures by about 10 to 15 minutes in the refrigerator. The temperature differential of the products are less than the air temperature differential. A lag temperature formula is presented in Table 2 to simulate the product temperature and since the simulated temperature is based on the air temperature, FF, and time,T, the zero adjust is continuous and the formula does not need to be reset for each cycle. The first line of Table 2 shows how the one-hour average temperature for each minute is calculated, as further described below.

TABLE 2

$$AV_t = \frac{(FF - AV_{t-1})}{60} + AV_{t-1}$$

$$LAGTEMP = (FF - AV_{t-15}) * .1$$
$$SIMCAL = LAGTEMP + AV_t$$

The formula, (second line of Table 2 above), shows how data is read from a buffer that holds the fresh food temperature offset (LAGTEMP) values for a period of time that is dependent on the refrigerator design. In this exemplary case this time offset is 15 minutes. The difference between the temperature 15 minutes before the present and the fresh food average temperature $AV_t$ for the current minute is calculated. This value, as shown in Table 2, is provided to account for the lower differential experienced by the product, compared to air. The fresh food average temperature is calculated as the average over one hour by adding per minute 1/60th of the difference between the actual fresh food air temperature and the one-hour average temperature for the previous minute (first line of Table 2). The sum of the lag-period temperature difference plus the average temperature is the simulated temperature SIMCAL (last line of Table 2). The result is plotted, labeled SIMCAL, along with the actual product temperatures in FIG. 3*g*.

Upon start-up the first fresh food air temperature reading is used to represent the initial average temperature. Calculating the average by this method circumvents the need to store 60 minutes worth of data, and the data continuously updates and requires no periodic reset.

Three methods of determining the product simulated temperatures have been described. The control advantage of using either actual product temperatures or calculated product simulated temperatures is to adjust the control cycle. When the temperature of the fresh food can be lowered by operating the fan independently from the compressor in accordance with the invention, temperature limits can be set based on the fresh food simulated temperature. The compressor run is terminated when the fresh food temperature simulation value is less than 32.0° F., to establish a low limit that will prevent the fresh food from freezing. FIG. 3*a* shows SIMCAL plotted during a conventional long compressor run that may result in the fresh food product to undercool.

It is within the present invention that the temperature of freezer products may be simulated by using methods similar to those above described, whereby temperature limits and control cycle adjustments can be made as a result of both the fresh food and the freezer product simulation values.

In the practice of the invention the compressor run cycle is terminated in one of three ways: by the minimum 30 minutes run time, by reaching the freezer control point or by temperature limit(s) achieved by the product simulation temperature value(s). With the compressor off and the evaporator fan still on, the fresh food air temperature either continues to fall or else remains constant as the freezer air temperature rises, and may fall for a period and then remain constant.

When the fan and compressor are both off, the freezer air and the fresh food air temperatures rise in a nonlinear relation to time. Looking again at the air temperature changes in FIG. 3*d*, it can be seen that within zone 50 the temperature-time slope decreases as the rising fresh food air temperature approaches the fresh food control point 30. During cooling, with the compressor and fan both on, the time temperature slope also exhibits a nonlinear characteristic in zone 51, as the falling freezer air temperature approaches the freezer control point at 35.

Conventional mechanical and electronic temperature controls for cooling operate motors or compressors in conventional vapor compression refrigeration systems basically, as follows: the compressor is turned on when the temperature is a fixed differential above a temperature setting and is switched off when the control reacts to a lowering temperature arriving at a fixed differential below the temperature setting. In the advanced temperature control of this invention, however, the differential from the temperature setting to the control point is a varied function that compensates for the nonlinear temperature response and for the combination of freezer and fresh food temperature settings.

TABLE 3

FFCTL =

$$\left[(\text{FFSET} + 4) - \frac{(\text{FFSET} - 32)^2}{100} + \frac{(5 - \text{FRZSET})}{5}\right]$$

FRZCTL =

$$\left[(\text{FRZSET} - 4) + \frac{(5 - \text{FRZSET})^2}{50} - \frac{(\text{FFSET} - 33)}{10}\right]$$

FOR FFSET = 38° F.
AND FRZSET = 0° F.
FFCTL = 42 − .36 + 1 = 42.6° F.
FRZCTL = −4 + .5 − .5 = −4° F.

Referring to Table 3, the formulas are given to calculate the control points, with typical temperature settings and typical examples of Fahrenheit degree differentials added to or subtracted from temperature settings and measurements. The Fresh Food Control Point, FFCTL, is the sum of three terms: the first term is a fixed differential of 4° above the Fresh Food Set Point FFSET; the second term accounts for nonlinear air temperature (FF) response having the effect of lowering the differential of the first term, and the third term is for the effect of the freezer temperature setting which increases the fresh food control temperature for freezer temperature settings below 5° F. and compensates for longer compressor runs associated with low have freezer temperature settings that may otherwise overcool the fresh food.

The freezer control temperature is calculated by a similar method. The first term sets a −4° F. differential to the freezer temperature setting, FRZSET, the second term takes into account the nonlinear temperature response of the freezer air temperature as it is cooling and approaching the freezer control point, and the third term compensates for the fresh food temperature setting by decreasing the freezer control temperature for fresh food temperature settings above 33. The sign of the terms in the FFCTL algorithm are opposite to the sign of the FRZCTL terms since a temperature slope of increasing temperature response is positive, decreasing temperature response is negative. The FFCTL algorithm initiates the cooling phase and the FRZCTL algorithm terminates the cooling phase and initiates the dwell phase or warming stage of the refrigerator cycle. By way of example, if a combination of fresh food and freezer settings of 38° F. and 0° F. is given for the formulas of the first two lines of Table 3, that results, as shown in the last four lines of Table 3 in a Fresh Food Control Temperature FFCTL equal to 42.6° F., and the Freezer Control FRZCTL = −4° F.

Both FFCTL and FRZCTL are automatically calculated promptly after FFSET or FRZSET, or both, have been given a new setting. FFCTL and FRZCTL are stored when calculated for availability to control circuits for the compressor and the evaporator fan.

Figure 4:
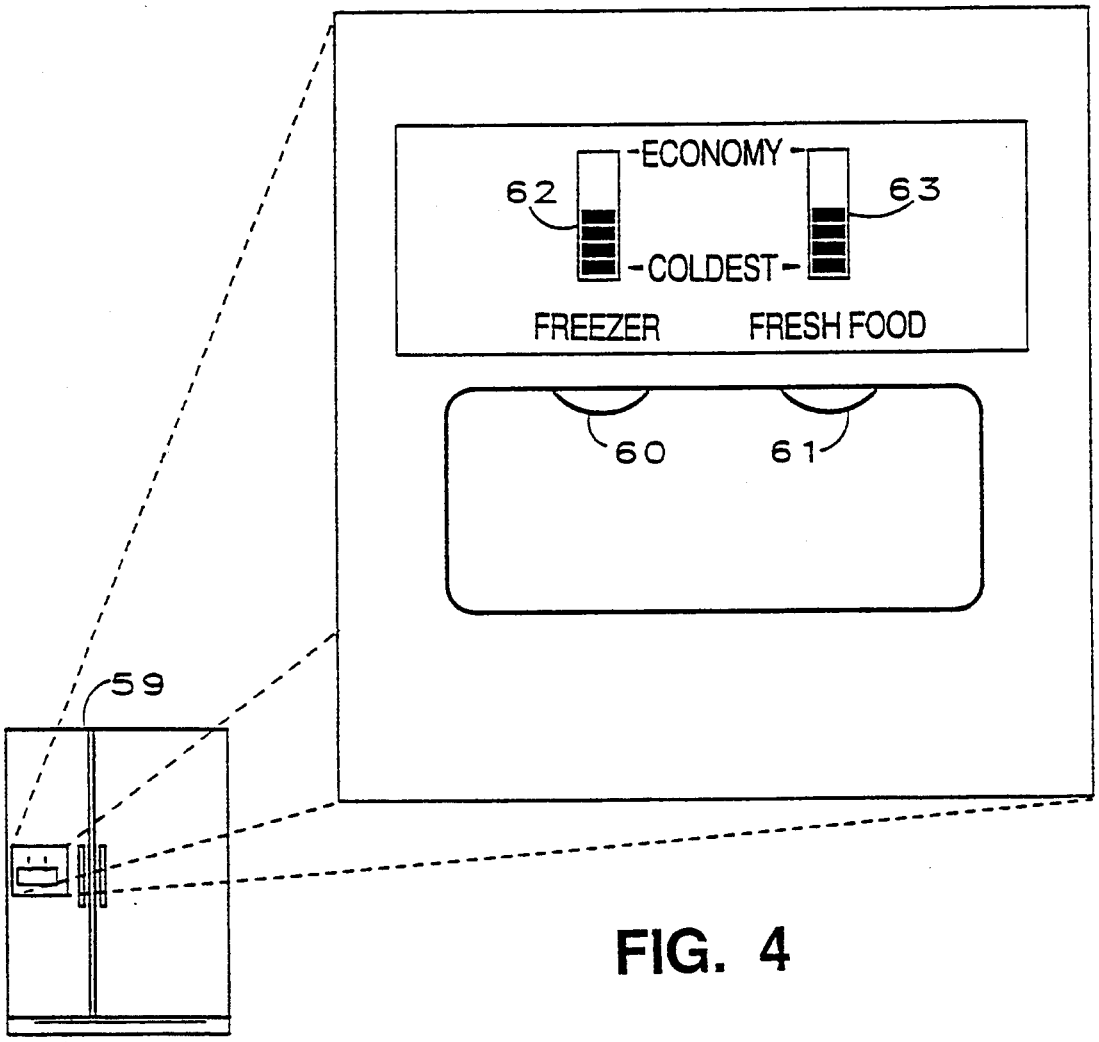
FIG. 4 is a graphic representation showing the control input and display features of the refrigerator/-freezer of FIG. 1.

FIG. 4 shows the setting devices of an electronic controller located within the door of a side-by-side refrigerator 59 which includes two control knobs 60,61 and a dual bargraph display 62,63 for adjusting the freezer and fresh food temperature setting temperatures. The LCD display (62,63) shown in FIG. 4 includes eight segments for each setting and is of the transflective type that can be used with or without backlighting. When only the bottom display segment is activated, each control is at the lowest setting. An activated segment is red and the display simulates a familiar red liquid thermometer rising with higher set points. The display bar graphs 62 and 63 are shown each with four active segments, thus set relatively at the mid temperatures 38° F. and 0° F. respectively. Control knobs 60 and 61 that manually adjust variable resistances are used to change the temperature settings. Each of the manually adjusted resistances is compared to a scale of resistance values, and each resistance value is resolved into the closest scale increment and displayed on the corresponding LCD bargraph shown in FIG. 4. This method is preferred to the more common push button technique since the settings do no clear or default in the event of a power interrupt, the variable resistors inherently have mechanical memory and the system will retain the temperature settings and would not require attention after a power interrupt.

Electrically, the controller may accept multiple temperature sensor inputs, not only thermistors 19, 20 (FIG. 1) and 29 (FIG. 2), but also humidity sensors (not shown) and sensors at output ports (not shown) to drive relays for the compressors, fans, and heaters. The output signals of the controller are sent to a power board located in the compartment under the refrigerator.

Figure 5:
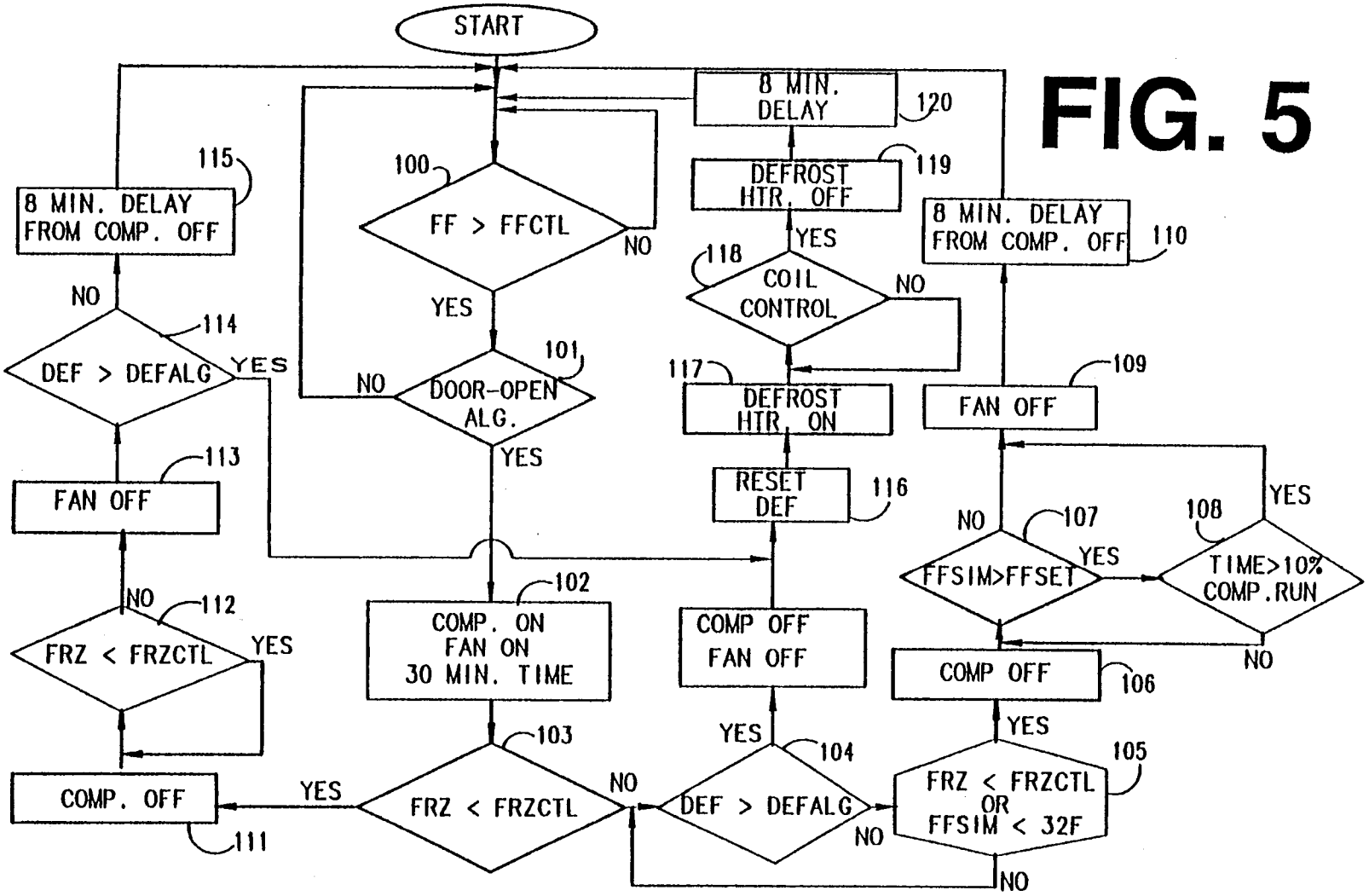
FIG. 5 is a flow chart of a preferred refrigerator control operation of this invention.

FIG. 5 is presented to further illustrate the refrigeration cycle of the present invention including the control sequence for the compressor, the evaporator fan and the defrost heater. Upon power up, the control logic resets all counters and memory registers and goes to start and immediately to the fresh food decision block 100 comparing the FF air temperature to the FFCTL, Fresh Food temperature setting. Initially, the FF temperature is greater than the FFCTL and the logic passes through the door opening algorithm 101, since the inside of the refrigerator at start up is about equal to the room temperature and there would be no recognition of door opening that would delay the compressor start, the next step 102 is to start the compressor and fan for the minimum 30 minutes run.

After the minimum compressor run time, the freezer air temperature FRZ is compared to the freezer control temperature algorithm at 103. Unless the ambient temperature is very low, it is likely on the first start up cycle that FRZ is>FRZCTL and the program logic goes to the next stage 104 that tests for the need to defrost. If the defrost algorithm does not call for defrosting, the FRZ is continuously compared at 105 to the FRZCTL until the freezer air temperature is less than the FRZCTL, while the Fresh Food Simulation Temperature, FFSIM, is checked for the low limit safety of FFSIM<32° F. that can override the FRZCTL comparison. Eventually the freezer air temperature will fall below the FRZSET and the compressor turns off at 106. Before turning off the evaporator fan, however, the FFSIM temperature is compared to the fresh food temperature setting, FFSET, at 107 to determine at 108 if the fan should continue to run transferring cold air to the fresh food compartment for a period of time up to 10% of the time of the last compressor run. This evaporator fan cycle, after the compressor is turned off, is a high temperature safety precaution for the fresh food products in this case. The evaporator fan is eventually turned off at 109 and a delay of 8 minutes from the time the compressor switched off is observed at 110, allowing the condenser to cool and pressure to equalize before starting the compressor again at 100 and to prevent overloading the compressor. The program then returns to the first stage 100 and FF is compared to FFCTL in order to start the compressor cycle for a second time.

After the thirty minute minimum run time, the Freezer Temperature, FRZ, is compared to FRZCTL. For example, this time (to describe all aspects of the cycle) the FRZ is less than FRZCTL and the compressor is immediately turned off at 111 with the evaporator fan still operating to transfer cool air from an overcooled freezer to the fresh food compartment. At 112 the independent fan cycle at this point will function only for up to five minutes, until the freezer air warms up to reach the FRZCTL point. The fan then turns off at 113 and the program checks at 114 for the need to defrost. If no defrost is required the program returns to the first decision block 100 for the third cycle after a standard 8 minutes compressor dwell 115. If defrost is required the control goes to the defrost sequence 116–120. The defrost algorithm, which is fully shown in FIG. 5 at 116–120, is adaptive to usage and humidity conditions, and to the compressor run time and is set up to vary the design defrost interval. Door openings and high humidity will reduce the time between defrost cycles and the interval between defrost cycles increases during periods of low usage. During the defrost period, the evaporator coil heater is controlled to minimize overshoot and increase the runoff. A thermistor 29 is strapped to the evaporator coil tubing (FIG. 2) to provide a feedback signal to control the coil at a temperature above freezing, say 45° F. for a period of time, for example 5 minutes, and dwell for 8 minutes before returning to the start of the third cycle.

Although the invention has been described by reference to particular examples, it will be recognized that variations and modifications are possible within the inventive concept.

For example, the differentials that are added or subtracted from temperature settings or measurements in TABLE 3 which are given, in ° F, as 4, 5 and 32, and the divisors 5, 10, 50 and 100 could, according to the particular refrigerator design, be within the limits of the following TABLE 4.

For still another example the time intervals of FIG. 5 need not be precisely as stated there and may in a practice vary within the limits set forth in Table 5.

TABLE 4

| Table 3 Value | Practical Value Range Min | Max |
|---|---|---|
| 4° F. | 2 | 6 |
| 5° F. | 3 | 8 |
| 33° F. | 31 | 35 |
| 32° F. | 30 | 34 |
| 5 | 3 | 7 |
| $10 = 2 \times 5$ | 6 | 14 |
| $50 = 2 \times 5^2$ | 18 | 98 |
| $100 = (2 \times 5)^2$ | 36 | 196 |

TABLE 5

| Time Interval of FIG. 5 | Range of practical Value |
|---|---|
| 8 min. delay | 6 to 11 min. |
| 30 min. time | 20 to 40 min. |
| 10% of compressor run | 7 to 14% |

I claim:

1. A refrigerator/freezer having a fresh food compartment (11) and a freezer compartment (12) separated by a first partition (13) and each having a door on a front side of said refrigerator/freezer, a compressor, condenser and a heat-removing fan (25) located below said compartments, and a single evaporator (22), a single defrost heater (26) and a single evaporator fan (18) located behind a second partition in the rear of at least said freezer compartment, said second partition having an outlet for discharging all chilled air propelled by said evaporator fan (18) into a top portion of said freezer compartment, a return path being provided for air supply to said evaporator and thence to said evaporator fan through respective vents (17, 21) of said compartments, and wherein:

a first port (14) in said first partition (13) and of constant aperture for passage of air from said freezer compartment to said fresh food compartment is located near said outlet of said evaporator fan, said top portion of said freezer compartment being empty and of a configuration for maintaining a steady proportion, of all air propelled by said evaporator fan through said outlet, which thereafter flows through said first port;

at least one other port (15, 16) is provided in said first partition (13), below said top empty portion of said freezer compartment, for passage of air from said freezer compartment to said fresh food compartment;

a first temperature sensor (19) is situated in an upper portion of said fresh food compartment below said first port for measuring the air temperature of said fresh food compartment;

a second temperature sensor (20) is situated in said freezer compartment to measure the air temperature of said freezer compartment;

control means, including manually operable means for establishing temperature settings respectively for air in said freezer and fresh food compartments, from which there are automatically calculated and stored by calculation means, a fresh food compartment temperature control value derived in a first predetermined manner from said respective fresh food compartment and freezer temperature settings and a freezer compartment temperature control value derived in a second predetermined way from said respective fresh food compartment and freezer compartment temperature settings, and means for starting said compressor and said evaporator fan when said fresh food compartment air temperature exceeds said fresh food compartment temperature control value, means for thereafter maintaining in operation both said compressor and said evaporator fan for a predetermined minimum time which is more than 20 minutes and less than 40 minutes and means for thereafter determining the respective stopping times of said compressor and of said evaporator fan in accordance with the following principles:

(A) if the freezer air temperature is less than said freezer compartment temperature control value, both the compressor and the evaporator fan operations are stopped;

(B) if the freezer air temperature is equal to or above said freezer compartment temperature control value, the compressor is kept operating if and until the freezer air temperature reaches said freezer compartment temperature control value and then stopping compressor operation, while said evaporator fan is kept operating if and until said fan has operated, since compressor stop, for more than a predetermined percentage of the duration of the last previous compressor operation, said predetermined percentage being greater than 8% and less than 12%.

2. The refrigerator/freezer of claim 1, wherein said fresh food compartment temperature control value and said freezer compartment temperature control value are respectively derived from said temperature settings by the respective formulas:

$$FFCTL = \left[ (FFSET + P) - \frac{(FFSET - Q)^2}{(2V)^2} + \frac{(W - FRZSET)}{V} \right]$$

$$FRZCTL = \left[ (FRZSET - X) + \frac{(Y - FRZSET)^2}{2V^2} - \frac{(FFSET - Z)}{2V} \right]$$

wherein the quantities designated by one or more letters are identified as follows:

| Symbol | Quantity |
|---|---|
| FFSET | FF temperature setting |
| P | a number (of °F.) less than 6 and more than 2 |
| Q | a number (of °F.) less than 34 and more than 30 |
| V | a number less than 8 and more than 3 |
| W | a number (of °F.) less than 8 and more than 3 |
| FRZSET | FRZ temperature setting |
| X | a number (of °F.) less than 6 and more than 2 |
| Y | a number (of °F.) less than 8 and more than 3 |
| Z | a number (of °F.) less than 35 and more than 31. |

3. The refrigerator/freezer of claim 2, wherein said symbols P, Q, V, W, X, Y and Z have respective numerical values 4, 32, 5, 5, 4, 5 and 33.

4. The refrigerator/freezer of claim 2, wherein said means for starting said compressor and evaporator fan include provision for observing the following delays before any start of said compressor and said evaporator fan:

(a) a delay following a rapid rise and subsequent dip of fresh food air temperature, indicating a door opening followed by door closing;

(b) a delay of a predetermined duration less than 11 minutes and more than 6 minutes following a last previous deactivation of said compressor, and (c) a delay of a predetermined duration less than 11 minutes and more than 6 minutes following deactivation of a defrost heater of said refrigerator/-freezer.

5. The refrigerator/freezer of claim 4, wherein said delays of a predetermined duration are delays of about 8 minutes and wherein said predetermined constant time period which is a minimum period of operation of said compressor has a duration of about 30 minutes.

6. The refrigerator/freezer of claim 1, wherein a fresh food simulated temperature is calculated, said calculation being performed by accumulation of degree-minutes in which, for each minute during which the evaporator fan is on, the difference between said fresh food air temperature and said fresh food temperature setting multiplied by a predetermined factor which is greater than 0.1 and less than 0.4 is added for each minute and, during the deactivation of said evaporator fan, for each minute the difference between said fresh food air temperature and said fresh food temperature setting multiplied by approximately 0.1 is added, for deactivating said evaporator fan when said accumulation exceeds said temperature setting for air in said fresh food compartment, whether or not said evaporator fan has then operated for said predetermined percentage of the duration of the last previous operation of said compressor.

7. The refrigerator/freezer of claim 1, wherein for the purpose of preventing overcooling fresh food in said fresh food compartment a simulated fresh food temperature is calculated by degree-temperature accumulation by adding to the average temperature for each minute 1/60th of a difference between the fresh food air temperature and said average temperature to produce the average temperature of the next minute and, at every minute after the lapse of a predetermined time interval more than 10 minutes and less than 20 minutes, the difference between said average temperatures over a span of said predetermined time interval is calculated, multiplied by a factor which is more than 0.5 and less than 0.2 and added to the said average temperature for the current minute and then stored until replaced by a value so calculated for the next minute and wherein the resulting temperature thus stored is compared with said temperature setting for air in said fresh food compartment when said evaporator fan is operating after said compressor is stopped, whereby said evaporator fan is stopped when said resulting temperature reaches said temperature setting.

8. The refrigerator/freezer of claim 7, wherein said predetermined time interval is 15 minutes and said factor is 0.1.

9. The refrigerator/freezer of claim 1, wherein in order to prevent excessive cooling of fresh food in said fresh food compartment, a simulated fresh food temperature sensor consisting of a temperature sensor enclosed in a solid material having heat conductivity approximating heat conductivity of fresh food is located in said fresh food compartment and said simulated fresh food temperature thereby obtained is used to deactivate said compressor when it runs more than 30 minutes if said simulated temperature is less than 32° F. and if said freezer air temperature is equal to or above said freezer compartment temperature control value and also to deactivate said evaporator fan if said simulated fresh food temperature is equal to or less than said fresh food temperature setting.

10. Control apparatus for a refrigerator having a fresh food compartment and a freezer compartment, a single compressor, a single evaporator, a single evaporator fan for supplying cooling air to said compartments, a sensor for each said compartment for measuring air temperature therein and return air ducts extending from said compartments to said evaporator, said control apparatus comprising:

means in said refrigerator for delivering into said fresh food compartment a substantially constant proportion of the air output of said evaporator fan while the remainder of said air output of said evaporator fan is delivered to said freezer compartment;

at least one port of fixed aperture size for allowing passage of air from said freezer compartment to said fresh food compartment;

means for manually establishing a fresh food compartment air temperature setting;

means for manually establishing a freezer compartment air temperature setting;

means for automatically calculating a fresh food compartment temperature control point from food both said air temperature settings and storing said fresh food compartment temperature control point;

means for automatically calculating a freezer compartment temperature control point and both said air temperature settings and storing said freezer compartment temperature control point; and electrical control circuits connected to said respective established air temperature settings and to said stored temperature control points for activating and deactivating said compressor and for activating and deactivating said evaporator fan in accordance with the following principles:

(1) if the compressor has been deactivated for at least a predetermined period which is greater than 6 minutes and less than 11 minutes and a defrost heater has been deactivated for at least a predetermined period which is greater than 6 minutes and less than 11 minutes and if the fresh food compartment air temperature exceeds said fresh food compartment temperature control point, both the compressor and the evaporator fan are activated for a predetermined constant time period which is greater than 20 minutes and less than 40 minutes, and thereafter (2A) if the freezer air temperature is below said freezer compartment temperature control point, both the compressor and the evaporator fan are deactivated;

(2B) if the freezer air temperature is equal to or above said freezer compartment temperature control point, the compressor is kept activated until the freezer air temperature falls below said freezer temperature control point and then said compressor is deactivated, and thereafter said evaporator fan remains activated if and until the activation time of said evaporator fan since compressor deactivation is more than a predetermined percentage of the duration of the last previous activation of said compressor, said predetermined percentage being greater than 8% and less than 12%.

11. The refrigerator control apparatus of claim 10, wherein said fresh food compartment temperature control point and said freezer compartment temperature control point are respectively derived from said air temperature settings by the respective formulas:

$$FFCTL = \left[ (FFSET + P) - \frac{(FFSET - Q)^2}{(2V)^2} + \frac{(W - FRZSET)}{V} \right]$$

$$FRZCTL = \left[ (FRZSET - X) + \frac{(Y - FRZSET)^2}{2V^2} - \frac{(FFSET - Z)}{2V} \right]$$

wherein the quantities designated by one or more letters are identified as follows:

| Symbol | Quantity |
|---|---|
| FFSET | FF air temperature setting |
| P | a number (of °F.) less than 6 and more than 2 |
| Q | a number (of °F.) less than 34 and more than 30 |
| V | a number less than 8 and more than 3 |
| W | a number (of °F.) less than 8 and more than 3 |
| FRZSET | FRZ air temperature setting |
| X | a number (of °F.) less than 6 and more than 2 |
| Y | a number (of °F.) less than 8 and more than 3 |

-continued

| Symbol | Quantity |
|---|---|
| Z | a number (of °F.) less than 35 and more than 31. |

12. The refrigerator control apparatus of claim 11, wherein said symbols P, Q, V, W, X, Y and Z have respective numerical values 4, 32, 5, 5, 4, 5 and 33.

13. The refrigerator control apparatus of claim 11, wherein said electrical control circuits for activating and deactivating said compressor and evaporator fan include provision for producing the following delays before any activation of said compressor and said evaporator fan:

(a) a delay following a rapid rise and subsequent dip of fresh food air temperature, indicating a door opening followed by door closing;

(b) a delay of a predetermined duration less than 11 minutes and more than 6 minutes following a last previous deactivation of said compressor, and (c) a delay of a predetermined duration less than 11 minutes and more than 6 minutes following deactivation of a defrost heater of said refrigerator.

14. The refrigerator control apparatus of claim 13, wherein said delays of a predetermined duration are delays of about 8 minutes and wherein said predetermined constant time period which is a minimum period of operation of said compressor has a duration of about 30 minutes.

15. The refrigerator control apparatus of claim 11, wherein a fresh food simulated temperature is calculated, said calculation being performed by accumulation of degree-minutes in which, for each minute during which the evaporator fan is on, the difference between said fresh food air temperature and said fresh food air temperature setting multiplied by a predetermined factor which is greater than 0.1 and less than 0.4 is added for each minute and, during the deactivation of said evaporator fan, for each minute the difference between said fresh food air temperature and said fresh food temperature setting multiplied by approximately 0.1 is added, for deactivating said evaporator fan when said accumulation exceeds said temperature setting for air in said fresh food compartment, whether or not said evaporator fan has then operated for said predetermined percentage of the duration of the last previous activation of said compressor.

16. The refrigerator control apparatus of claim 10, wherein for the purpose of preventing overcooling fresh food in said fresh food compartment a simulated fresh food temperature is calculated by degree-temperature accumulation by adding to the average temperature for each minute 1/60th of a difference between the fresh food air temperature and said average temperature to produce the average temperature of the next minute and, at every minute after the lapse of a predetermined time interval more than 10 minutes and less than 20 minutes, the difference between said average temperatures over a span of said predetermined time interval is calculated, multiplied by a factor which is more than 0.5 and less than 0.2 and added to the said average temperature for the current minute and then stored until replaced by a value so calculated for the next minute and wherein the resulting temperature thus stored is compared with said temperature setting for air in said fresh food compartment when said evaporator fan remains activated after said compressor is deactivated, whereby said evaporator fan is deactivated when said resulting temperature reaches said air temperature setting.

17. The refrigerator control apparatus of claim 16, wherein said predetermined time interval is 15 minutes and said factor is 0.1.

18. The refrigerator control apparatus of claim 11, wherein in order to prevent excessive cooling of fresh food in said fresh food compartment, a simulated fresh food temperature sensor consisting of a temperature sensor enclosed in a solid material having heat conductivity approximating heat conductivity of fresh food is located in said fresh food compartment and said simulated fresh food temperature thereby obtained is used to deactivate said compressor when it runs more than 30 minutes if said simulated temperature is less than 32° F. and if said freezer air temperature is equal to or above said freezer compartment temperature control value and also to deactivate said evaporator fan if said simulated fresh food temperature is equal to or less than said fresh food air temperature setting.

19. A method of economically operating a refrigerator/freezer having a fresh food compartment and a freezer compartment, a single compressor, a single evaporator, a single evaporator fan, a first air temperature measuring sensor in said fresh food compartment, a second air temperature measuring sensor in said freezer compartment, a first manual control for establishing a first temperature setting for said fresh food compartment, a second manual control for establishing a second temperature setting for said freezer compartment temperature sensor, and means for calculating respective temperature control points for said freezer compartment and for said fresh food compartment from said temperature settings, said method comprising performing the preliminary steps of:

providing for a substantially constant distribution ratio of cooling air output portions from said evaporator fan respectively supplied directly to said fresh food compartment and to said freezer compartment and setting, or accepting a previous setting of, each of said manual controls, and entering necessary temperature offset values needed for calculating control points;

calculating and storing a fresh food compartment air temperature control point (FFCTL) according to $$FFCTL = (FFSET - P) + \frac{(FFSET - Q)^2}{(2V)^2} + \frac{(FFSET - W)}{V} \text{ and}$$

a freezer compartment air temperature control point (FRZCTL) according to $$FRZCTL = (FRZSET - X) + \frac{(Y - FRZSET)^2}{2V^2} - \frac{(FFSET - Z)}{2V}$$

wherein the quantities designated by one or more letters are defined in the table appended hereto, and thereafter performing the operating steps of:

activating both said compressor and said evaporator fan if or when FFCTL exceeds the fresh food compartment air temperature;

operating said compressor and said evaporator fan for a predetermined minimum period which is less than 40 minutes and more than 20 minutes;

thereafter deactivating said compressor if or when said freezer compartment air temperature is less than said freezer compartment air temperature control point and deactivating said evaporator fan, after deactivation of said compressor, as soon as said freezer compartment air temperature is equal to or greater than said freezer compartment air temperature control point, except that whenever said compressor and fan continue operating after operating for said predetermined minimum period, said evaporator fan must continue operating for a predetermined percentage, not less than 8% or greater than 12%, of the most recent running time, between activation and following deactivation, of said compressor;

after said deactivation of said evaporator fan, assuring a predetermined minimum delay beginning at the deactivation of said compressor before a new cycle of operation of said compressor and said evaporator fan is initiated, said minimum delay being greater than 6 minutes and less than 12 minutes, and then repeating the above-defined operating steps of this method as many times as needed, the above mentioned quantities designated by one or more letters being further identified as follows:

| Symbol | Nature | Quantity |
|---|---|---|
| FFSET | setting °F. | first temperature setting |
| FRZSET | setting °F. | second temperature setting |
| P,X | offset °F. | a number <6 and >2 |
| Q | offset °F. | a number <34 and >30 |
| W,Y | offset °F. | a number <8 and >3 |
| V | division factor | a number <7 and >3 |
| Z | offset °F. | a number <35 and >31. |

20. The method of refrigerator/freezer operation of claim 19, wherein said symbols P, Q, V, W, X, Y and Z have respective numerical values 4, 32, 5, 5, 4, 5 and 33.

21. The method of refrigerator/freezer operation of claim 19, wherein the step of activating said compressor and evaporator fan includes requiring the following delays before any activation of said compressor and said evaporator fan begins:

(a) a delay following a rapid rise and subsequent dip of fresh food air temperature, indicating a door opening followed by door closing;

(b) a delay of a predetermined duration less than 11 minutes and more than 6 minutes following a last previous deactivation of said compressor, and (c) a delay of a predetermined duration less than 11 minutes and more than 6 minutes following deactivation of a defrost heater of said refrigerator/-freezer.

22. The method of refrigerator/freezer operation of claim 21, wherein said delays of a predetermined duration are delays of about 8 minutes and wherein said predetermined minimum period of operation of said compressor has a duration of about 30 minutes.

23. The method of operation of claim 19, wherein a fresh food simulated temperature is calculated, said calculation being performed by accumulation of degree-minutes in which, for each minute during which the evaporator fan is operating, the difference between said fresh food air temperature and said fresh food temperature setting multiplied by a predetermined factor which is greater than 0.1 and less than 0.4 is added for each minute and, for each minute during which said evaporator fan is deactivated, the difference between said fresh food air temperature and said fresh food temperature setting multiplied by approximately 0.1 is added, for producing deactivation of said evaporator fan when said accumulation exceeds said temperature setting for air in said fresh food compartment, whether or not said evaporator fan has then operated for said predetermined percentage of the duration of the last previous operation of said compressor.

24. The method of refrigerator/freezer operation of claim 19, wherein for the purpose of preventing overcooling fresh food in said fresh food compartment a simulated fresh food temperature is calculated by degree-temperature accumulation by adding to the average temperature for each minute 1/60th of a difference between the fresh food air temperature and said average temperature to produce the average temperature of the next minute and, at every minute after the lapse of a predetermined time interval more than 10 minutes and less than 20 minutes, the difference between said average temperatures over a span of said predetermined time interval is calculated, multiplied by a factor which is more than 0.5 and less than 0.2 and added to the said average temperature for the current minute and then stored until replaced by a value so calculated for the next minute and wherein the resulting temperature thus stored is compared with said temperature setting for air in said fresh food compartment when said evaporator fan is operating after said compressor is deactivated, whereby said evaporator fan is deactivated when said resulting temperature reaches said air temperature setting.

25. The method of refrigerator/freezer operation of claim 24, wherein said predetermined time interval is 15 minutes and said factor is 0.1.

26. The method of refrigerator/freezer operation of claim 19, wherein in order to prevent excessive cooling of fresh food in said fresh food compartment, a simulated fresh food temperature sensor consisting of a temperature sensor enclosed in a solid material having heat conductivity approximating heat conductivity of fresh food is located in said fresh food compartment and the method step is performed of deactivating said compressor when it runs more than 30 minutes if said simulated fresh food temperature is less than 32° F. and if said freezer air temperature is equal to or above said freezer compartment temperature control point and also to deactivate said evaporator fan if said simulated fresh food temperature is equal to or less than said fresh food temperature setting.

* * * * *